US005791336A

United States Patent [19]

Helm

[11] Patent Number: 5,791,336

[45] Date of Patent: Aug. 11, 1998

[54] FRAMELESS COOKTOP

[75] Inventor: Daniel A. Helm, Brownsburg, Ind.

[73] Assignee: Maytag Corporation, Newton, Iowa

[21] Appl. No.: 799,841

[22] Filed: Feb. 13, 1997

[51] Int. Cl.[6] ..... F24C 3/00

[52] U.S. Cl. ..... 126/39 H; 126/39 J; 126/214 A; 219/464

[58] Field of Search ..... 126/39 J, 39 H, 126/214 A; 219/464

[56] References Cited

U.S. PATENT DOCUMENTS

| | | | |
|---|---|---|---|
| 3,345,498 | 10/1967 | Siegla | 219/464 |
| 3,346,720 | 10/1967 | Siegla | 219/464 |
| 3,412,727 | 11/1968 | Hurko | 126/211 |
| 3,567,906 | 3/1971 | Hurko | 219/464 |
| 3,838,249 | 9/1974 | Detterbeck | 219/464 |
| 3,870,862 | 3/1975 | Doner | 219/464 |
| 4,243,016 | 1/1981 | Kristen et al. | 126/211 |
| 4,363,956 | 12/1982 | Scheidler et al. | 219/464 |
| 4,453,533 | 6/1984 | Scheidler et al. | 126/211 |
| 4,580,550 | 4/1986 | Kristen et al. | 126/39 H |
| 5,036,831 | 8/1991 | Ray | 126/211 |
| 5,185,047 | 2/1993 | Ray | 156/242 |
| 5,317,129 | 5/1994 | Taplan et al. | 219/464 |

*Primary Examiner*—Carroll B. Dority
*Attorney, Agent, or Firm*—Brinks Hofer Gilson & Lione

[57] ABSTRACT

Apparatus for mounting a cooking panel to a top surface without a visible circumferential frame or visible sealants/adhesives is disclosed. An assembly of a cooking panel and a burner box may be suspended in a recess formed in a top with a support member having a roll-form with an inverted L-shaped cross-section. The invention further includes a method for mounting a ceramic cooking panel within a recess formed in a countertop by suspending the assembly of the cooking panel and a burner box through the cooktop by the support member.

16 Claims, 1 Drawing Sheet

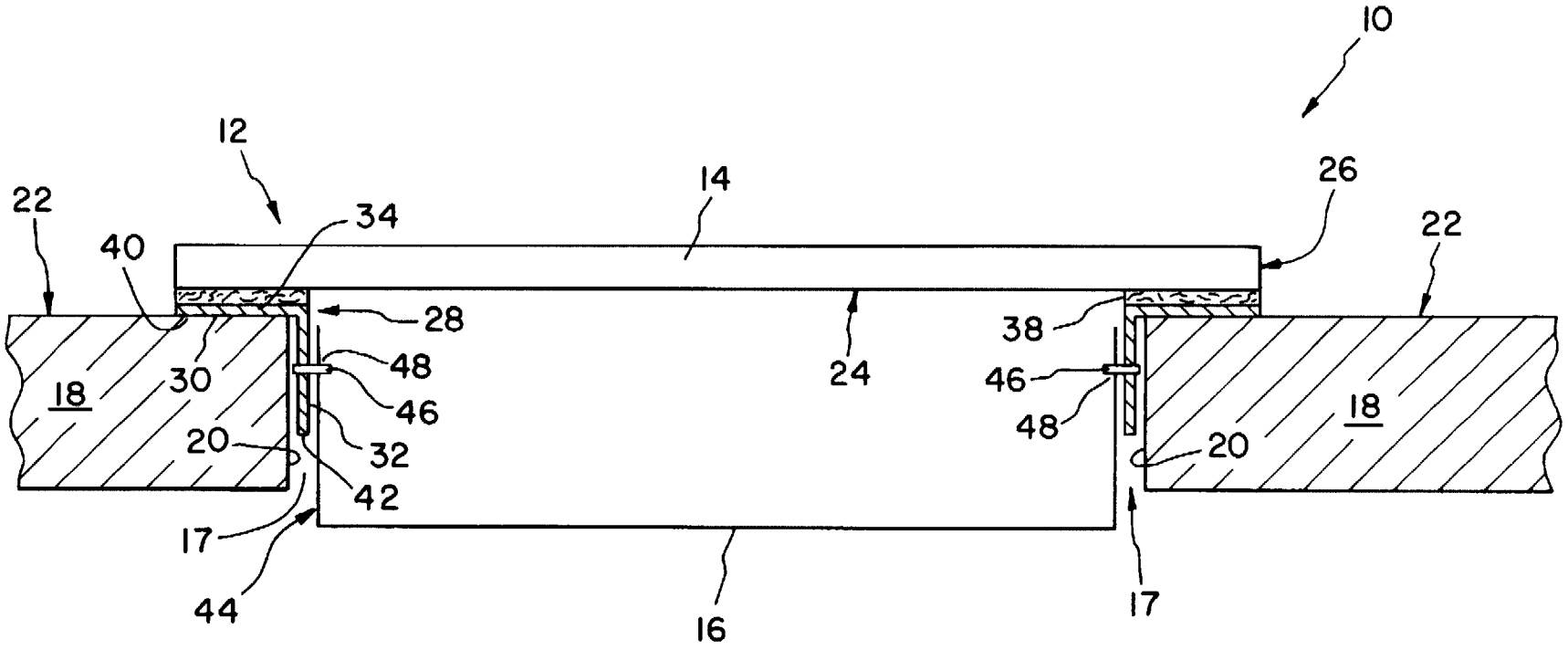
10
22
26
18
20
17
38
46
48
24
14
16
28
48
46
32
42
34
12
30
20
17
44
40
18
22

FRAMELESS COOKTOP

The present invention relates generally to cooking panels including ceramic and glass cooking panels, and more particularly, to a method of and apparatus for mounting a ceramic cooking panel on a countertop, without need for a visible surrounding frame, sealant or adhesive between the cooking panel and the countertop.

BACKGROUND OF THE INVENTION

Cooking panels and especially ceramic cooking panels have become increasingly popular in recent years. Conventional mounting arrangements for mounting a cooking panel to a cooktop include providing a frame for the ceramic cooking panel to mount into and this frame is in turn attached to the cooktop, such as a countertop. According to some conventional mounting arrangements, a metal frame structurally encompasses the cooking panel oftentimes with a sealant or adhesive provided between the frame and the edge of the cooking panel. The metal frame can also serve as decorative trim to cover a gap between the countertop and the cooktop.

For example, U.S. Pat. Nos. 3,412,727; 3,567,906; 3,870,862; 4,243,016; 4,363,956; and 4,453,533 all disclose framed constructions for securing a cooking panel to a cooktop.

These conventional mounting techniques have been generally satisfactory although those approaches include certain disadvantages, including decreased cleanability due to the exposed frame edges, and the additional complexity and expense of providing an external metal frame between the cooking panel and countertop. Additionally, the added complexity of prior art frames increases assembly and installation costs, and typically prevents easy removal of the cooktop and cooking panel for repair and replacement of heating units and associated components.

Moreover, in recent times, consumers have come to prefer a "cleaner" look without metal frames and visible sealants/adhesives. In particular, and in the case where the metal frame has a distinctive color and finish, some consumers object to the compound visual contrast between the countertop, metal frame and cooking panel, preferring a direct visual transition between the countertop and the cooking panel to which it is mounted. Thus, it is desirable to provide a cooking panel assembly of a cooking panel and burner box which is received and secured to a countertop without a visible frame, sealants or adhesives, and which is easily removable from the countertop for repair and replacement of assembly components.

SUMMARY OF THE INVENTION

So as to overcome the shortcomings of prior art apparatus, the present invention provides a cooking assembly of a ceramic cooking panel and burner box, without a prior art circumferential metal frame and visible sealants/adhesives, thereby eliminating the compound visual contrast between the countertop and cooking panel and providing enhanced cleanability with reduced complexity. According to the invention, the burner box is carried by a supporting member attached to the underside of the cooking panel within its periphery and concealed from view so that when the cooking assembly is installed, only the cooking panel is visible. Moreover, it has been found that this configuration offers a reduced susceptibility to impact damage.

In the invention, a roll form support member with an inverted L-shaped cross-section is attached to the bottom surface of the cooking panel adjacent to its peripheral edge. The L-shaped cross-section includes orthogonal portions, with a first portion being attached to the bottom surface of the cooking panel and a second portion extending downwardly from the first member inwardly of the outer edge of the cooking panel. The second, downwardly extending portion is attached to a burner box with removable fasteners so that the burner box is carried in suspension by the roll form support member rather than by a metal frame, as is conventionally achieved, and the second portion further enables precise alignment of the heating units in the burner box with burner indicators on the cooking panel prior to installation in the countertop. The resulting cooking panel/burner box assembly can be positioned in a recess formed in the countertop with the first member of the support member and peripheral edge of the cooking panel overlapping the cooktop in the installed condition and supporting the burner box. Advantageously, since the burner box is attached to the cooking panel, the cooking panel/burner box assembly can be readily installed and removed from the countertop as an integral unit and the cooking panel thereafter separated from the burner box for repairs and/or maintenance.

The invention further includes a method for mounting the ceramic cooking panel on a cooktop having a recess formed or provided therein. The method comprises the steps of providing a ceramic cooking panel having an underside and a peripheral edge suspending the burner box from the underside of the cooking panel within its peripheral edge to provide a supporting surface on the underside of the ceramic panel and inserting the assembly of the ceramic cooking panel and burner box into the recess with the supporting surface overlapping the edge of the recess and supporting the burner box. The method further includes a positioning step for positioning and attaching a support member to the bottom surface adjacent a peripheral edge of the cooking panel.

These and additional features and advantages of the invention will be more apparent in the following detailed description of a preferred embodiment taken in conjunction with the accompanying drawing.

BRIEF DESCRIPTION OF THE DRAWING

The FIGURE is a side elevational view showing a cooking panel assembly of the invention, including a ceramic cooking panel, as installed in a recess formed in a countertop which is shown in cross-section.

DETAILED DESCRIPTION OF THE DRAWING

Referring to the drawing, a cooking panel assembly indicated generally by the reference numeral 10 includes an assembly 12 of a cooking panel 14 and a burner box 16. The assembly 12, when installed, may be received in a recess 17 formed in a countertop or cooktop 18 such as a shaped hole having a vertical wall 20 for partially receiving the assembly 12 of the cooking panel 14 and burner box 16 extending from the underside thereof in nesting relationship. Alternatively, the assembly 12 of the cooking panel 14 and burner box 16 may be received within a void defined by two or more opposing edges or walls of a like number of countertop or cooktop panels (like 18). In either case, the countertop or cooktop 18 includes a top surface 22 which is finished with finish and coloration as may be desired. In like manner, the cooking panel 14, such as a ceramic cooking panel, may be finished with a finish and coloration which matches or contrasts with the finish and coloration of the top surface 22. In either case, with the cooking panel assembly 10 of the invention, no visible metal frame is necessary, and in the installed condition, a portion of the cooking panel 14 overlaps an edge portion of the countertop 18 to completely encompass and cover the recess 17 and provides a single visual transition between the cooking panel 14 and countertop 18.

The cooking panel 14 is preferably fabricated of CERAN, Model No. 802745, manufactured by Schott Glaswerke, Mainz, Federal Republic of Germany, or similar material, and includes an underside bottom surface 24 and a peripheral edge 26. The peripheral edge 26 provided by the CERAN Model No. 802745 panel has been found to be less susceptible to impact damage and is thus desirable for use in an active kitchen environment.

The cooking panel 14 is secured to the burner box 16 by a support member 28 formed from a roll form having an inverted L-shaped cross section with first, horizontal portion 30 transitioning to a second, vertical portion 32 which carries burner box 16 in the assembly. Specifically, the first portion 30 includes a top, generally planar surface 34 for confronting the bottom surface 24 of the cooking panel 14, optionally with a bead of adhesive 38 or other bonding agent provided therebetween. The first portion 30 also includes a bottom, generally planar surface 40 for directly engaging with a portion of the top surface 22 of the countertop 18. The second, vertical portion 32 extends from an inner edge of the first, horizontal portion 30, into a gap 42 provided between the vertical wall 20 and generally vertical outer periphery 44 of the burner box 16. The support member 28 can be attached to the bottom surface of the cooling panel 14 at a plurality of fastening locations, but preferably comprises a continuous strip with dimensions to fit closely within the gap 42. The second, vertical portion 32 is attached to the burner box 16 by removable fasteners 46, such as sheet metal screws, rivets, pins, bolts or the like which are projected through recesses 48 provided in spaced array around the periphery 44 of the burner box 16. It will be understood that recesses 48 are sized and shaped to provide for vertical and horizontal adjustment of the burner box 16 relative to the cooking panel 14.

The burner box 16 houses one or more burners or heating elements (not shown) for the cooking panel 14 and thermally isolates it from ancillary components surrounding the cooking assembly 10. For instance, the burner box 16 may include without limitation a control panel, control switches, and burner indicator lights. The control switches and indicator lights may be mounted inside the burner box 16 below the control panel. Preferably, the heating elements or burners are located and secured within the burner box 16 by one or more attachment clips (not shown) to secure the heating elements, control switches and burner indicators in alignment with the control panel against shifting and dislocation during installation or removal of the assembly 12 from the cooktop 18 and during cooking use of the cooking panel assembly 10. Removable fasteners permit the burner box 16 to be easily separated from the cooking panel 14 to facilitate servicing of the heating element(s) and associated components and hardware in the burner box 16 and then be easily reassembled prior to reinstallation in the countertop 18. During installation, the assembly 12 is lowered into the recess 17 provided in the countertop 18 or between countertop or cooktop panels and is retained in position by the support member 28 in its engagement with the top surface 22 and between the opposing walls 20, 44 forming the gap 42. When the assembly 12 is fully and accurately positioned in the recess 17, the peripheral edges of the cooking panel 14 extend beyond the opposing walls 20, thereby overlapping and enclosing the recess 17. Although the support member 28 can rest directly on the top surface 22 of the countertop 18, as illustrated, it will be appreciated that another bead or strip of sealant (not shown) or a resilient seal can be positioned between the bottom surface 40 of support member 28 and the opposing portion of the top surface 22 to further prevent spilled liquids and the like from seeping under the cooking panel 14. Furthermore, the system allows for precise alignment of the burner box 16 under the cooking panel 14 to ensure that the burner units align with their respective burner indicators (not shown) provided on the surface of the cooking panel 14. Thus, the assembly 12 of the cooking panel 14 and burner box 16 of the present invention can be readily installed, repositioned, and removed for repairs or maintenance, without contending with the hardware and extra fittings and training of the prior art.

Although a preferred embodiment of the invention has been described herein, it will be apparent to those skilled in the art to which the invention pertains that variations and modifications of the described embodiment may be made without departing from the spirit and scope of the invention.

I claim:

1. A cooking assembly, comprising:

a cooking panel having an underside with a lateral extent;

a burner box;

an L-shaped support member attached to the underside of the cooking panel and within its lateral extent for carrying the burner box in suspension from the underside of the cooking panel, the L-shaped support member providing an engageable surface within the lateral extent of the cooking panel for support of the burner box.

2. The cooking assembly of claim 1, wherein the L-shaped support member includes a first portion providing said engageable surface for securing the L-shaped support member beneath the lateral extent of the cooking panel, and a second portion secured to a periphery of the burner box.

3. The cooking assembly of claim 1, wherein the L-shaped support member is inverted and extends about a portion of the burner box.

4. The cooking panel of claim 2, further comprising a sealant disposed between the first portion and the cook panel, wherein the sealant is concealed from view in the installed condition.

5. The cooking assembly of claim 1, wherein the burner box is aligned to the cooking panel by selective adjustment of the L-shaped support.

6. The cooking assembly of claim 5, wherein the L-shape support member is removably secured to the cooking panel and the burner box with at least one fastener.

7. The cooking assembly of claim 1, wherein the cooking panel comprises a ceramic-glass cooking panel construction.

8. A cooking assembly, comprising:

a ceramic panel having a top surface, a bottom surface and a peripheral edge;

a burner box; and an L-shaped support member attached to the bottom surface of the ceramic panel for supporting the burner box in suspension;

wherein the peripheral edge of the ceramic panel overlaps the L-shaped support member and conceals the L-shaped support member from view.

9. The cooking assembly of claim 8, wherein the L-shaped support member may be operatively mounted with the peripheral edge of the ceramic panel.

10. The cooking assembly of claim 9, wherein the burner box is removably connected with the L-shaped support member by at least one removable fastener.

11. A cooking assembly, comprising:

a ceramic panel having a top surface a bottom surface and a peripheral edge;

a burner box;

an inverted L-shaped support member attached to the bottom surface of the ceramic panel for supporting the burner box in suspension;

wherein the peripheral edge of the ceramic panel overlaps the support member and conceal the L-shaped support member from view;

wherein the panel may be operatively mounted with the peripheral edge of the panel uncovered with the burner box depending from the support member; and wherein the L-shaped support member includes first and second orthogonal portions, the first portion being attached to the bottom surface and the second portion being attached to the burner box.

12. A cooking assembly for insertion into a recess provided in a countertop, the assembly comprising:

a ceramic cooking panel having a bottom surface and a peripheral edge; and an L-shaped support member coupled to the bottom surface of the cooking panel adjacent to the peripheral edge, the cooking panel covering the recess with its peripheral edge being operatively uncovered when the cooking assembly is fully inserted in the countertop recess; and a burner box connected with the vertical portion of the L-shaped support member for housing at least one burner assembly.

13. The cooking assembly of claim 12, wherein the support member includes a portion with an L-shaped cross-section having orthogonal portions, a first orthogonal portion being attached to the bottom surface and a second orthogonal portion being attached to the burner box to support the burner box in the recess.

14. A method for mounting a ceramic cooking panel to a top having a recess, the method comprising the steps of:

providing a ceramic panel having an underside and a peripheral edge;

attaching an L-shaped support member to the underside of the ceramic panel adjacent its peripheral edge;

suspending a burner box from the underside of the ceramic panel with the L-shaped support member being positioned within the peripheral edge of the ceramic panel to provide a supporting surface on the underside of the ceramic panel;

inserting the assembly of the ceramic panel, the L-shaped support member and the burner box into the recess with the supporting surface overlapping the edge of the recess and supporting the burner box with a vertical surface of the L-shaped support member.

15. The method of claim 14, comprising the additional step of positioning the L-shaped support member, burner box, and cooking panel in corresponding alignment.

16. The method of claim 15, comprising the additional step of aligning the cooking panel and burner box within the top recess and concealing the L-shaped support member from view.

* * * * *